US008331838B2

(12) United States Patent
Suzuki

(10) Patent No.: US 8,331,838 B2
(45) Date of Patent: Dec. 11, 2012

(54) IMAGE FORMING APPARATUS WITH ONE-SIDED ALIGNMENT DETECTION

(75) Inventor: Noboru Suzuki, Aichi (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 235 days.

(21) Appl. No.: 12/724,137

(22) Filed: Mar. 15, 2010

(65) Prior Publication Data

US 2011/0064439 A1 Mar. 17, 2011

(30) Foreign Application Priority Data

Sep. 15, 2009 (JP) ..... 2009-213198

(51) Int. Cl.
*G03G 15/20* (2006.01)

(52) U.S. Cl. ..... 399/322; 399/33; 399/68; 399/69; 399/395; 399/405; 347/16

(58) Field of Classification Search ..... 399/33, 399/66, 67, 68, 322, 388, 405
See application file for complete search history.

(56) References Cited

U.S. PATENT DOCUMENTS 5,268,726 A * 12/1993 Oleksa et al. ..... 399/322
6,615,017 B2 * 9/2003 Tanaka ..... 399/322
6,674,979 B2 * 1/2004 Nagano ..... 399/68
7,280,775 B2 * 10/2007 Kubochi et al. ..... 399/33
7,742,736 B2 * 6/2010 Kobayashi et al. ..... 399/389
2003/0165348 A1 9/2003 Amita et al.
2006/0062610 A1 * 3/2006 Ito et al. ..... 399/328
2007/0002089 A1 * 1/2007 Kobayashi et al. ..... 347/16
2010/0061786 A1 * 3/2010 Van Bortel et al. ..... 399/400

FOREIGN PATENT DOCUMENTS

JP 2003-155162 A 5/2003
JP 2003-255750 A 9/2003
JP 2006208823 A * 8/2006
JP 2007-199524 A 8/2007

* cited by examiner

*Primary Examiner* — David Gray
*Assistant Examiner* — Francis Gray
(74) *Attorney, Agent, or Firm* — Scully, Scott, Murphy & Presser, PC

(57) ABSTRACT

An image forming apparatus is provided. The image forming apparatus includes a fixing unit to thermally fix an image transferred onto a sheet, a discharge unit to discharge the sheet carried from the fixing unit outside the image forming apparatus through a discharge path, a swingable member to be swung by the sheet being discharged, a swing-detectable sensor to detect swing movement of the swingable member being swung by the sheet, and a judging unit to judge as to whether the sheet is in one-sided alignment, in which the sheet is aligned to one of the widthwise sides in the discharge path based on result detected by the swing-detectable sensor.

8 Claims, 7 Drawing Sheets

| | RESULT DETECTED BY LEFT-SIDE SENSOR | RESULT DETECTED BY RIGHT-SIDE SENSOR | JUDGEMENT |
|---|---|---|---|
| P1 | + | + | CENTER |
| P2 | + | − | ONE-SIDE |
| P3 | − | + | ONE-SIDE |
| $P_L$ | + | + | CENTER |

| | RESULT DETECTED BY SWING-DETECTABLE SENSOR | JUDGEMENT |
|---|---|---|
| P1 | + | CENTER |
| P2 | − | ONE-SIDE |
| P3 | + | CENTER |
| $P_L$ | + | CENTER |

IMAGE FORMING APPARATUS WITH ONE-SIDED ALIGNMENT DETECTION

CROSS REFERENCE TO RELATED APPLICATION

This application claims priority from Japanese Patent Application No. 2009-213198, filed on Sep. 15, 2009, the entire subject matter of which is incorporated herein by reference.

BACKGROUND

1. Technical Field

An aspect of the present invention relates to an image forming apparatus having a fixing unit to thermally fix a transferred image onto a recording sheet.

2. Related Art

An image forming apparatus to form an image electrophotographicaily is often provided with a fixing device, which thermally fixes a toner image transferred to a recording sheet thereon. For example, a fixing device including a heat roller to heat the recording sheet with the toner image and a pressure roller to press the recording sheet against the heat roller are known. As the recording sheet is fed in between the heat roller and the pressure roller, the toner image is thermally fixed onto the recording sheet.

When smaller-sized recording sheets, smaller than axial lengths of the rollers, such as postcards, are fed in the fixing device, a part of the heat roller which does not contact the recording sheets retains heat, and temperature in the part may increase to be higher than temperature in the remaining part which contacts the recording sheet. If the temperature is excessively increased, bearings to hold the heat roller may melt and deformed. In order to avoid such deformation, therefore, the fixing device may be equipped with a heat sensor, which senses the temperature of the heat roller so that the fixing operation in the fixing device can be ceased when the sensor detects excessively increased temperature in the heat roller.

SUMMARY

The fixing device may be equipped with a plurality of sensors to detect excessively increased temperature in the heat roller; however, in order to provide the image forming apparatus including a fixing device in lower manufacturing cost, it is preferable that the quantity of the sensors is reduced to, for example, one to be provided solely on one of the two sides of the heat roller. With the one-sided sensor, however, temperature in the other side of the heat roller, on which no sensor is provided, is not detected specifically when the smaller-sized recording sheets are fed in off-centered one-sided alignment. In consequence, the bearing on the other side may melt. In order to avoid the one-sided alignment of the recording sheets, a sensor to detect the alignment of the recording sheets with respect to a feeding path may be provided, although the additional sensor increases the manufacturing cost.

In view of the above difficulties, the present invention is advantageous in that an image forming apparatus, which is capable of detecting the one-sided alignment of the recording sheets whilst the manufacturing cost is maintained lower, is provided.

According to an aspect of the present invention, an image forming apparatus is provided. The image forming apparatus includes a fixing unit to thermally fix an image transferred onto a sheet, a discharge unit to discharge the sheet carried from the fixing unit outside the image forming apparatus through a discharge path, a swingable member to be swung by the sheet being discharged, a swing-detectable sensor to detect swing movement of the swingable member being swung by the sheet, and a judging unit to judge as to whether the sheet is in one-sided alignment, in which the sheet is aligned to one of the widthwise sides in the discharge path based on result detected by the swing-detectable sensor.

BRIEF DESCRIPTION OF THE ACCOMPANYING DRAWINGS

DETAILED DESCRIPTION

Hereinafter, embodiments according to the present invention will be described with reference to the accompanying drawings.

First Embodiment

A color printer 1 being an image forming apparatus will be described. In the following description, overall configuration and behaviors of the color printer 1 will be described. Further, a controlling flow to judge one-sided alignment of recording sheets P, behaviors of the color printer 1 based on the judgment, and configuration related to the behaviors will be described.

Figure 1:
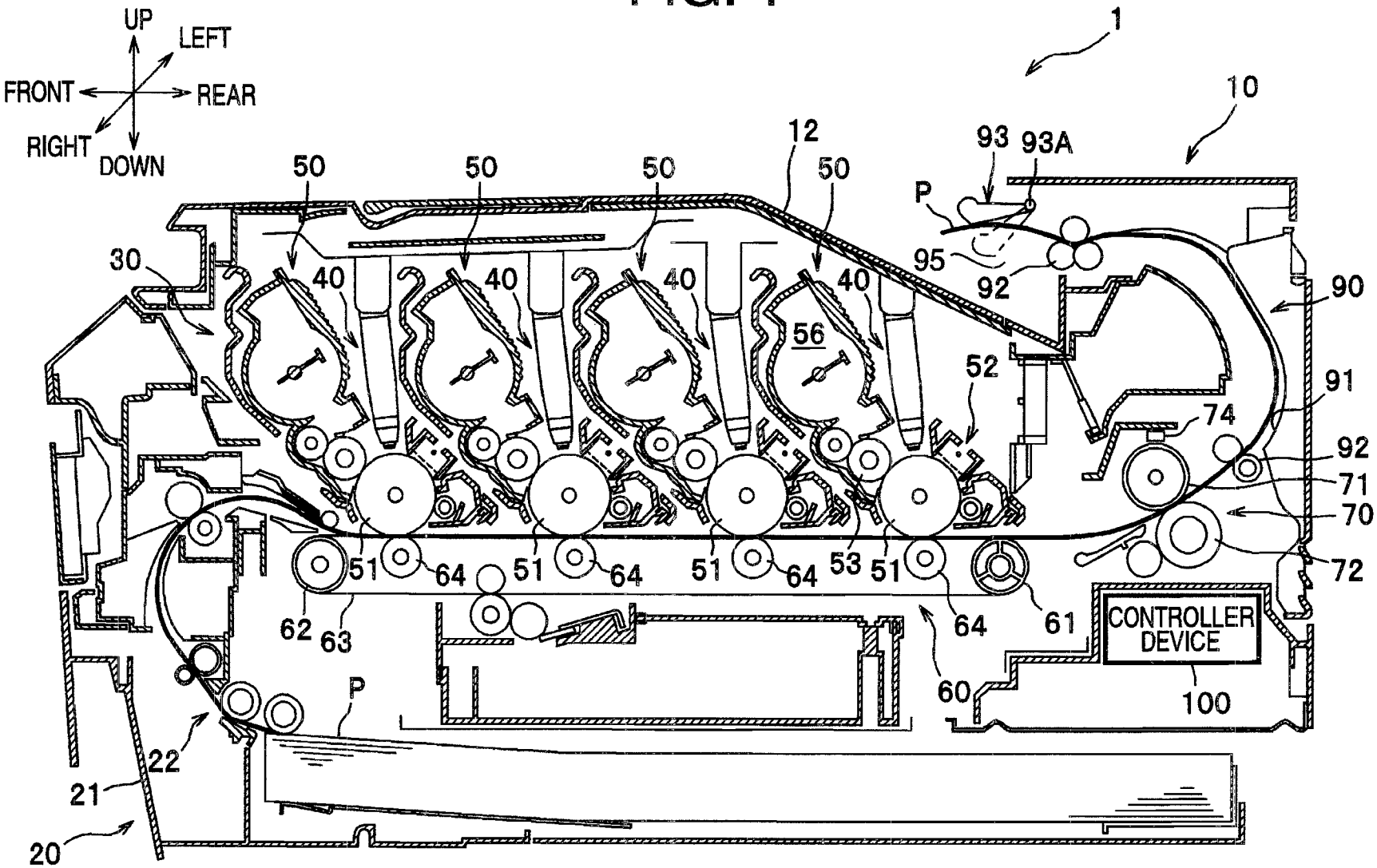
FIG. 1 is a cross-sectional side view of a color printer according to an embodiment of the present invention.
Figure 2:
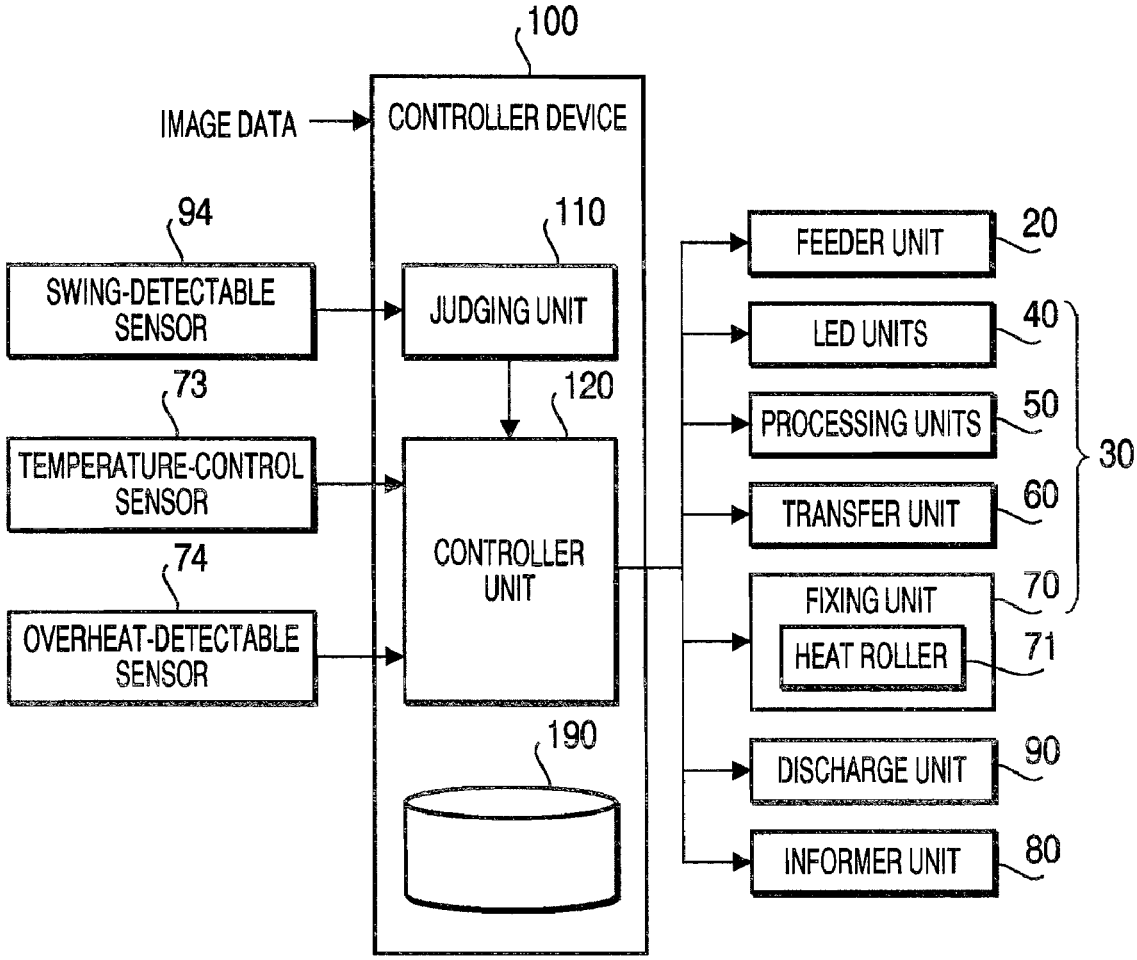
FIG. 2 is a block diagram to illustrate overall configuration of the color printer according to the embodiment of the present invention.

In the embodiments described below, directions concerning the color printer 1 will be referred to in accordance with the orientation of the color printer 1 shown in FIG. 1. That is, a left-hand side in FIG. 1 is referred to as front, and a right-hand side is referred to as rear. Further, a right-left direction of the printer 1 refers to a direction perpendicular to the cross-section of the printer 1 in FIG. 1, and is also referred to as a widthwise direction. A closer side in FIG. 1 is referred to as right, and a further side in FIG. 1 is referred to as left. An up-down direction shown in FIG. 1 corresponds to the up-down (i.e., vertical) direction of the color printer 1.

Overall Configuration of the Color Printer

The color printer 1 according to the present embodiment includes a feeder unit 20 to feed recording sheets P in a feeding path, an image forming unit 30 to form images on the recording sheets P, and a discharge unit 9*n* to discharge the recording sheets P with the printed images, and a controller device 100 within a chassis 10.

In the color printer 1, the recording sheets P are carried in the feeding path with reference to a widthwise center thereof. That is, the recording sheets P are fed in the chassis 10 with the widthwise center thereof being aligned to a center of the feeding path regardless of sizes of the recording sheets P to have images formed thereon and to be discharged out of the chassis 10. The configuration to feed the recording sheets P in the centered alignment is known; therefore, explanation of that is omitted.

The feeder unit 20 is provided in a lower portion in the chassis 10 and includes a sheet tray 21 to store the recording sheets P therein and a feeding mechanism 22 to pick up the recording sheets P one by one from the sheet tray 21 and feed to the image forming unit 30.

The image forming unit 30 includes four LED units 40, four processing units 50, a transfer unit 60, and a fixing unit 70.

Each of the LED units 40 is arranged in a position above one of four photosensitive drums 51 and has a plurality of light emitters (not shown), i.e., LEDs, aligned in an axial direction of the photosensitive drum 51 (i.e., the widthwise direction of the color printer 1) at a lower end portion thereof. The LED unit 40 emits light from the LEDs selectively according to inputted image data to an electrically charged surface of the photosensitive drum 51.

The processing units 50 are arranged in line in the front-rear direction between the discharge tray 12 and the feeder unit 20. Each of the processing units 50 includes the photosensitive drum 51, a charger 52, a developer roller 53, and a toner container 56.

The transfer unit 60 is arranged in a position between the feeder unit 20 and the processing units 50. The transfer unit 60 includes a driving roller 61, a driven roller 62, a conveyer belt 63 being an endless belt extended to encircle the driving roller 61 and the driven roller 62, and four transfer rollers 64. The conveyer belt 63 is in contact with the surfaces of the photosensitive drums 51 at an upper external surface thereof and with surfaces of the transfer rollers 64 at an upper internal surface thereof so that the transfer rollers 64 and the photosensitive drums 51 nip the upper part of the conveyer belt 63 therebetween.

The fixing unit 70 is arranged in a position closer to the rear of the chassis 10 with respect to the processing units 50 and the transfer unit 60. The fixing unit 70 includes a heat roller 71 and a pressure roller to press against the heat roller 71.

In the image forming unit 30, the photosensitive surface of the photosensitive drum 51 is uniformly charged by the charger 52 and thereafter exposed to the light emitted from the LED unit 40 so that a latent image is formed on the surface of the photosensitive drum 51 based on the image data. The latent image is provided with the toner by the developer roller 53, which carries the toner in a thin layer on a surface thereof. Thus, a toner image is developed on the surface of the photosensitive drum 51.

When the recording sheet P is carried on the conveyer belt 63 and passes in between the photosensitive drums 51 and the transfer rollers 64, the toner images formed on the photosensitive drums 51 are transferred in layers onto the recording sheet P. The recording sheet P is further carried in between the heat roller 71 and the pressure roller 72 so that the toner images formed on the recording sheet P are thermally fixed thereon.

The discharge unit 90 is arranged in a rear portion in the chassis 10 and includes a discharge path 91, which is in connection with an outlet of the fixing unit 70 and extends in a curve to upward-front to an outlet 95 of the chassis 10, and a plurality of conveyer rollers 92, which carry the recording sheet P along the discharge path 91. The recording sheet P carried by the conveyer rollers 92 is discharged out of the chassis 10 onto the discharge tray 12, which is formed in a top portion of the chassis 10.

Controller Device

Next, a controlling flow to judge one-sided alignment of recording sheets P, behaviors of the color printer 1 based on the judgment, and configuration related to the behaviors will be described.

The controller device 100 is arranged in the chassis 10 and includes a judging unit 110 and a controller unit 120. The controller device 100 includes a storage unit 190 and a CPU (not shown), and an I/O circuit (not shown). Signals from various kinds of sensors are inputted in the controller device 100, and the CPU executes programs stored in the storage unit 190 to achieve functions of the color printer 1.

The judging unit 110 judges one-sided alignment of the recording sheet P in the feeding path based on sensed result detected by a swing-detectable sensor 94, which will be described later in detail.

The one-sided alignment refers to a position of the recording sheet P in the feeding path. When the recording sheet P is in the one-sided alignment, the recording sheet P which has to be fed in centered alignment in the widthwise center of the feeding path is carried off-centered to either side in feeding path. The one-sided alignment may occur, for example, when a user sets the recording sheets P in the sheet tray 21 in an off-centered position closer to either side.

The controller unit 120 controls behaviors of the color printer 1 according to the programs, data stored in the storage unit 190, and outputs from the sensors and the judging unit 110. Behaviors to be controlled according to judgement made by the judging unit 110 will be described later in detail.

The color printer 1 in the present embodiment further includes an informer unit 80, which provides the user with various kinds of messages (e.g., warning). The informer unit 80 includes, for example, a display to present text and images through a screen, a speaker to generate a message sound, and lamps to notify the user of events by illumination and blinking. The informer unit 80 may include two or more of the display, the speaker, and the lamps.

Discharge Unit

The discharge unit 90 includes swingable pieces 93, and a swing-detectable sensor 94 (see FIG. 4) in addition to the discharge path 91 and the conveyer rollers 92.

The swingable pieces 93 are arranged in the vicinity of the outlet of the discharge path 91 to restrain the recording sheets P being discharged. The swingable pieces 93 can restrain the recording sheets P carried in the discharge path 91 from straying turbulent. Each of the swingable pieces 91 is swingable at a lower part thereof about a swingable axis 93A, and is rotatably uplifted to swing by a front end of the recording sheet P being discharged out of the discharge path 91. The uplifted swingable pieces 93 are illustrated in solid lines in FIG. 3. When the recording sheet P is completely discharged out of the discharge path 91 and forwarded in the discharge tray 12, the swingable pieces 93 are released from the pressure of the recording sheet P to swing back and return in original positions by, for example, force of springs or their own weight of the swingable pieces 93. The original positions of the swingable pieces 93 are indicated in chained lines in FIG. 3.

Figure 3:
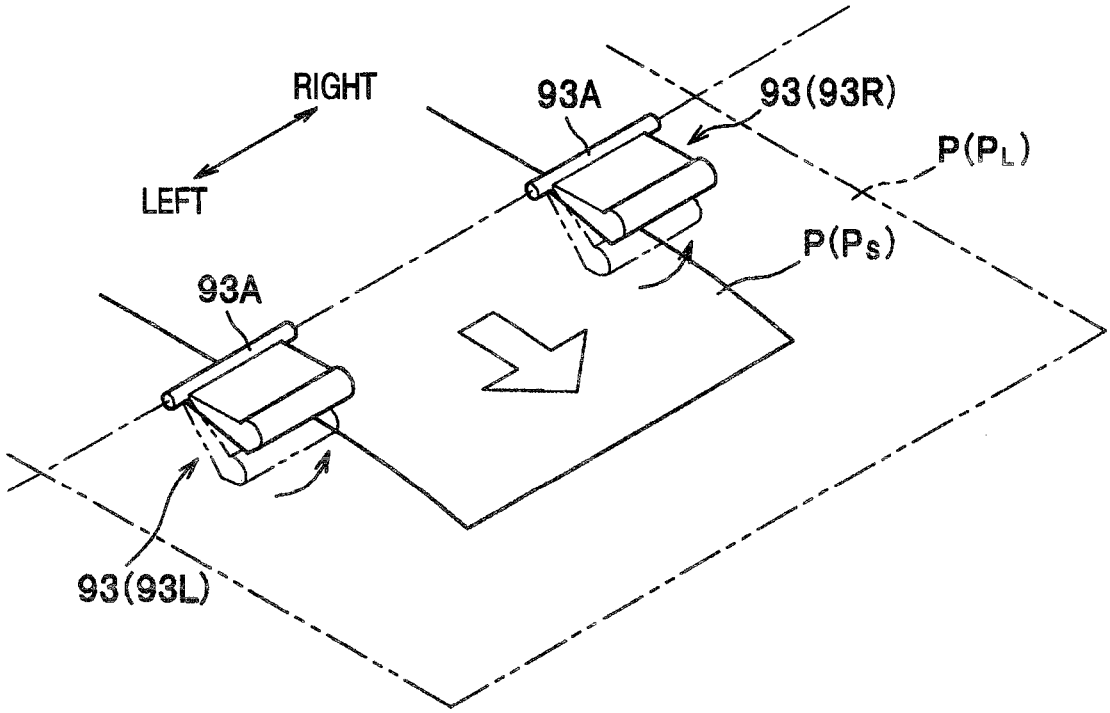
FIG. 3 is an illustrative view of swingable pieces in the color printer according to the embodiment of the present invention.

As shown in FIG. 3, the discharge unit 90 is provided with two swingable pieces 93, which align in line in parallel with the widthwise direction of the recording sheet P. In particular, the swingable pieces 93 include a left-side swingable piece 93L and a right-side swingable piece 93R. The swingable pieces 93 are in positions, in which a recording sheet Ps in a minimum allowable size can reach the swingable pieces 93 at both ends when the recording sheet Ps is carried normally in the centered alignment to the end of the discharge path 91. The minimum allowable size is a smallest allowable size of the recording sheet P to be processed in the color printer 1, and the minimum-allowable sized recording sheet P has a smallest allowable width to be processed in the color printer 1. The recording sheet Ps in the minimum allowable size may be, for example, a postcard.

Figures 5A, 5B:
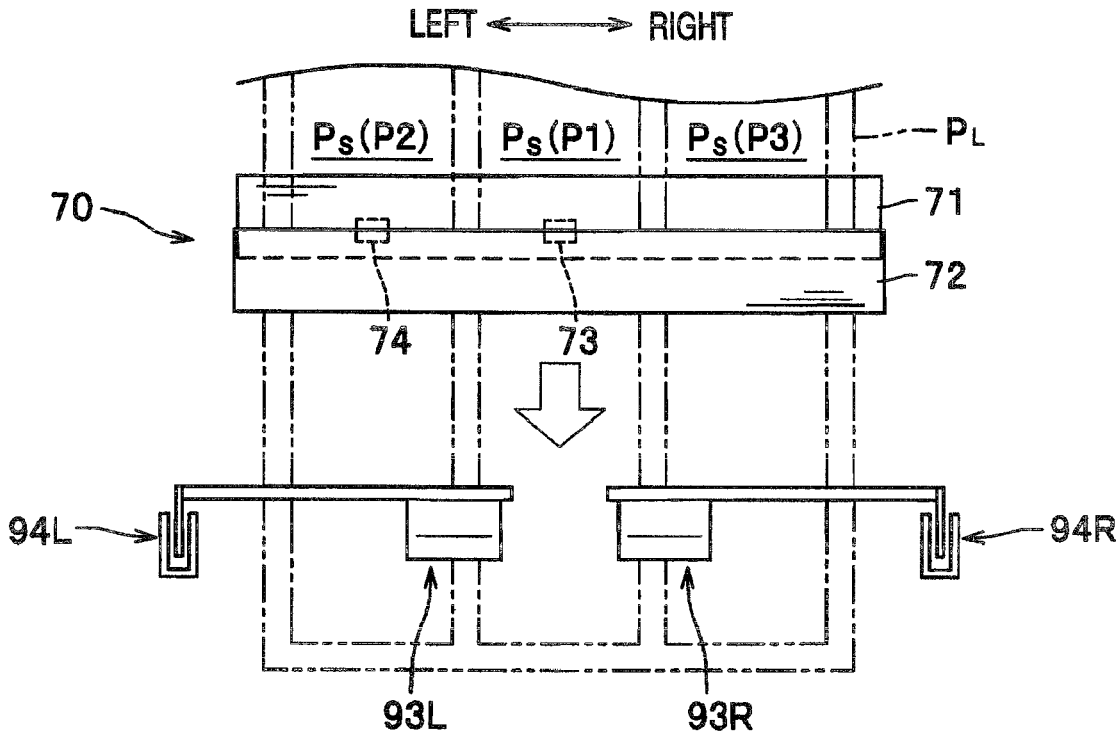
FIG. 5A illustrates a sheet-feeding behavior in the color printer according to a first embodiment of the present invention.
FIG. 5B is a table to illustrate criteria to judge one-sided alignment of the sheet and judgment results to be derived in the color printer according to the first embodiment of the present invention.

With the swingable pieces 93 in the above positions, as shown in FIG. 5A, when the recording sheet Ps in the minimum allowable size is carried in the discharge path 91 in left-sided alignment, the recording sheet Ps can contact the left-side swingable piece 93L at a right side thereof. Meanwhile, when the recording sheet Ps in the minimum allowable size is carried in the discharge path 91 in right-sided alignment, the recording sheet Ps can contact the right-side swingable piece 93R at a left side thereof.

The swingable axis 93A of the left-side swingable piece 93L and the swingable axis 93A of the right-side swingable piece 93R are in a same line, but the left-side swingable piece 93L and the right-side swingable piece 93R are swingable independently from and not in cooperation with each other.

If the widthwise ends of the recording sheet P fed in the discharge path 91 are upwardly curled, the swingable pieces 93 suppress the curled ends of the recording sheet P downward to settle. Therefore, irregular deformation of the recording sheet P in the widthwise direction can be corrected. Thus, the recording sheets P can be stacked stably, and drop of the previously discharged recording sheet P from the discharge tray 12, pushed by a subsequent recording sheet P, can be avoided.

Figure 4A:
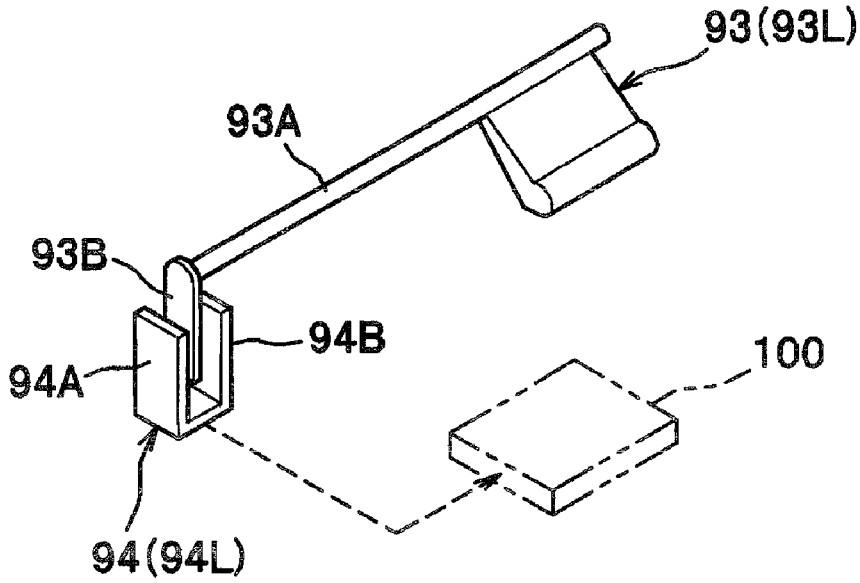
FIGS. 4A and 4B illustrate behaviors of the swingable pieces in the color printer according to the embodiment of the present invention.
Figure 4B:
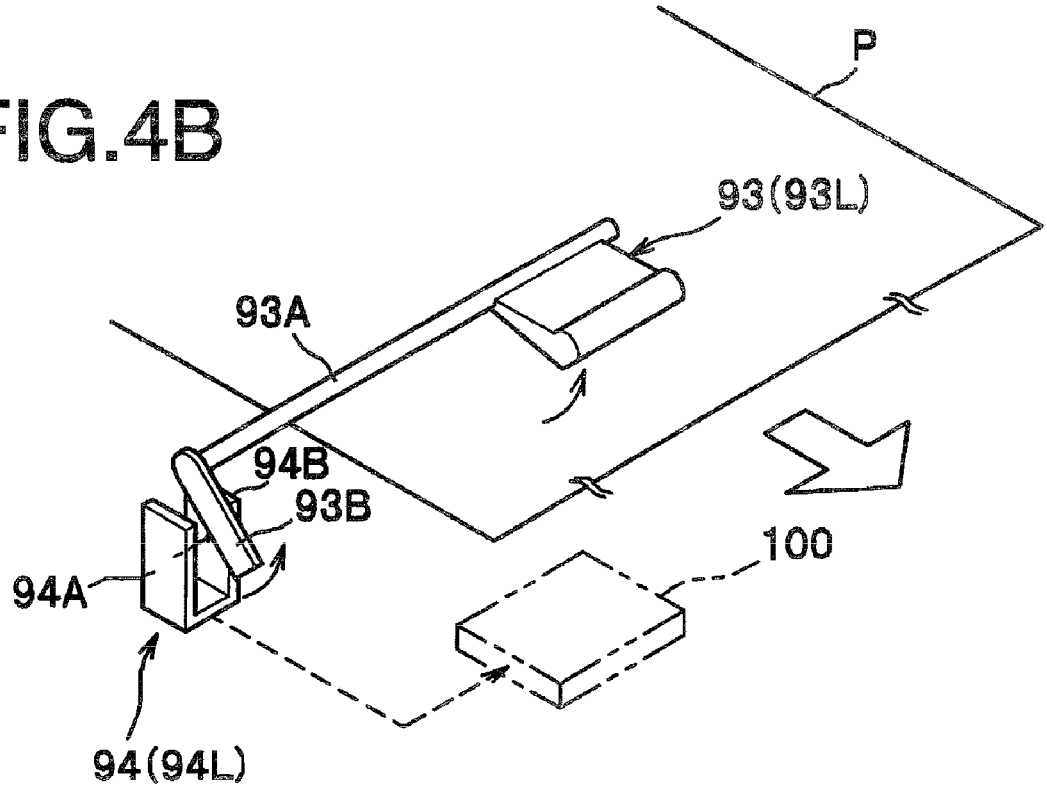

The swing-detectable sensors 94 including a left-side swing-detectable sensor 94L and a right-side swing-detectable sensor 94R are known optical sensors, which detect swing movement of the swingable pieces 93. The swing-detectable sensor 94L is illustrated in FIGS. 4A and 4B. The swing-detectable sensor 94L includes a light-emitter 94A to emit light and a light-receiver 94B to receive the light emitted from the light-emitter 94A. The swing-detectable sensor 94 outputs signals representing status of the light received in the light-receiver 94B to the controller device 100.

As shown in FIG. 4A, the swing-detectable sensor 94L has a light-blocker 93B at a lateral end of the swing axis 93A. When the left-side swingable piece 93L is not in contact with the recording sheet P and is released from the recording sheet P, the light-blocker 93B is in a position between the light-emitter 94A and the light-receiver 94B. Accordingly, the light emitted from the light-emitter 94A is blocked by the light-blocker 93B and does not reach the light-receiver 94B to be received.

When the recording sheet P being discharged out of the chassis 10 to the discharge tray 12 comes in contact with the left-side swingable piece 93L and rotatably uplifts the left-side swingable piece 93L, the light-blocker 93B is rotated upward accordingly and moves out of the path of the light emitted from the light-emitter 94A. Thereby the light emitted from the light-emitter 94A is allowed to reach the light-receiver 94B to be received and detected by the light-receiver 94B. Thus, the swing-detectable sensor 94L detects the swing movement of the left-side swingable piece 93L.

The swing-detectable sensor 94R is in a configuration similar but symmetry to the swing-detectable sensor 94L and detects swing movement of the right-side swingable piece 93R. Description of the swing-detectable sensor 94R is therefore omitted.

Fixing Unit

The fixing unit 70 as shown in FIG. 5A includes a temperature-control sensor 73 and an overheat detectable sensor 74 being a heat sensor in addition to the heat roller 71 and the pressure roller 72. In FIG. 5A, the fixing unit 70 is drawn in the top plane view including the swingable pieces 93 for simplicity in explanation.

In the present embodiment, the overheat detectable sensor 74 being a heat sensor refers to a sensor detectable of a plurality of different temperatures in a predetermined temperature range (e.g., a thermistor) and does not include a breaker or an interrupter such as a thermostat or a fuse which blocks power to a heater (e.g., a halogen lamp) in response to a predetermined temperature.

The temperature-control sensor 73 is arranged in the vicinity of and above an axial center of the heat roller 71 and detects temperature of a circumferential surface of the heat roller 71. The temperature in the heat roller 71 is controlled in the color printer 1 based on the sensed result detected by the temperature-control sensor 73. The configuration to control the temperature is known; therefore, description of that is herein omitted.

The overheat detectable sensor 74 is arranged in a position in the vicinity of and above one of the axial ends of the heat roller 71 closer to the left-side end in the widthwise direction. Thus, the overheat detectable sensor 74 detects temperature of a circumferential surface of the left-side portion of the heat roller 71. The fixing unit 70 according to the present embodiment does not have an overheat detectable sensor to detect temperature of a circumferential surface of a right-side portion of the heat roller 71.

More specifically, the overheat detectable sensor 74 is in a position above the heat roller on an outer side of the left-side end of the minimum-allowable sized recording sheet Ps (i.e., P1 in FIG. 5A) being carried in the centered alignment. Meanwhile, no overheat detectable sensor is provided in a position above the heat roller 71 on an outer side of the right-side end of the minimum-allowable sized recording sheet Ps being carried in the centered alignment.

When the overheat detectable sensor 74 detects excessive heat in the heat roller 71, the controller unit 120 in the color printer 1, for example, shuts down power to a heat generator to heat the circumferential surface of the heat roller 71 so that the temperature in the heat roller 71 is prevented from being further increased. According to the present embodiment, when the heat generation in the heat roller 71 is ceased, the informer unit 80 informs the user of alert concerning the excessive heat in the heat roller 71 by, for example, an alarm sound.

Further, if the color printer 1 is in an image forming operation when the heat generation in the heat roller 71 is ceased, the controller unit 120 of the color printer 1 ejects the recording sheet P in the feeding path and aborts the image forming behaviors. If the color printer is not in an image forming operation, the control unit 120 controls the color printer 1 not to start a new image forming operation even if the user's instruction to start the image forming operation is entered. The above behaviors of the control unit 120 are a known controlling method to prevent failure in the image forming apparatus. In the present embodiment, an operation mode, in which the color printer 1 operates in the controlling method, is referred to as a normal mode.

Judging the One-Sided Alignment

Next, a method to judge the one-sided alignment of the recording sheet P by the judging unit 110 will be described. Judging starts when the image data to be printed is inputted in the color printer 1.

When the image data is inputted, the recording sheet P is fed by the feeder unit 20 to have the image formed thereon in the image forming unit 30. The recording sheet P is thereafter discharged out of the chassis 10 by the discharge unit 90, and if the swingable piece 93 swing, the swing-detectable sensors 94 detect the swing movement of the swingable pieces 93.

According to the result detected by the swing-detectable sensors 94, the judging unit 110 determines that the recording sheet P is carried in the one-sided alignment when a swing movement is detected by one of the left and right swing-detectable sensors 94L, 94R, and stillness, i.e., no swing movement, is detected by the other of the left and right swing-detectable sensors 94L, 94R within a predetermined time period which starts upon input of the image data and ends, for example, upon completion of discharge of the recording sheet P. That is, the judging unit 110 judges that the recording sheet P is fed in the one-sided alignment when solely one of the left and right swing-detectable sensors 94L, 94R detects the swing movement of the corresponding swingable pieces 93.

In particular, as shown in FIGS. 5A and 5B, if the minimum-allowable sized recording sheet Ps (i.e., P1) or a recording sheet P1 in a maximum allowable size can reach both of the swingable pieces at each widthwise end thereof when the recording sheet Ps, Pl is carried normally in the centered alignment, the left-side end and the right-side end of the recording sheet Ps, P1 rotatably uplift the left-side swingable piece 93L, and the right-side swingable piece 93R respectively. (The recording sheet P1 in the maximum allowable size may be, for example, a letter-sized paper.) Therefore, the left and right swing-detectable sensors 94L, 94R detect the swing movement of the swingable pieces 93L, 93R respectively within the predetermined time period, and affirmative (+) judgments are made for the results detected by the left and right swing-detectable sensors 94L, 94R. Thus, the judging unit 110 determines that the recording sheet P is fed in the centered alignment (i.e., judgment "CENTER" is made).

When the minimum-allowable sized recording sheet Ps (i.e., P2) is carried in the one-sided alignment, specifically, aligned to the left-side end of the discharge path 91, the recording sheet Ps becomes in contact with and rotatably uplifts the left-side swingable piece 93L. Meanwhile, the right-side end of the recording sheet Ps does not reach the right-side swingable piece 93R; therefore, the right-side swingable piece 93R is not uplifted by the recording sheet Ps within the predetermined time period. Accordingly, the left-side swing-detectable sensor 94L detects the swing movement of the left-side swingable piece 94L, and affirmative (+) judgment is made for the result detected by the left-side swingable piece 93L. On the other hand, the right-side swing-detectable sensor 94R detects no swing movement of the right-side swingable piece 91R, and negative (−) judgment is made for the result detected by the right-side swingable piece 93R. Thus, the judging unit 110 determines that the recording sheet Ps is fed in the one-sided alignment (i.e., judgment "ONE-SIDE" is made).

Similarly, when the minimum-allowable sized recording sheet Ps (i.e., P3) is carried in the one-sided alignment, specifically, aligned to the right-side end of the discharge path 91, the recording sheet Ps becomes in contact with and rotatably uplifts the right-side swingable piece 93R. Meanwhile, the left-side end of the recording sheet P does not uplift the left-side swingable piece 93L within the predetermined time period. Accordingly, negative (−) judgment is made based on the result detected by the left-side swing-detectable sensor 94L, and affirmative (+) judgment is made based on the result detected by the right-side swing-detectable sensor 94R. Thus, the judgment unit 110 determines that the recording sheet Ps is fed in the one-sided alignment (i.e., judgment "ONE-SIDE" is made).

It is to be noted that the judgment of the sheet alignment can be made on basis of the recording sheet P or in predetermined timings after input of the image data and during the image forming operation. For example, the judgment may be made for the first page in the printing operation or for every time a predetermined number of pages are fed.

Controlling Flow after Judgment

Next, a flow to control the color printer 1 after the judgment made by the judging unit 110 will be described.

If the recording sheet P3 is carried in the one-sided alignment to be aligned to the right-side end of the discharge path 91, which is the side having no overheat detectable sensor thereon, the left-side portion of the heat roller 71 may be excessively heated. However, the excessively increased temperature can be detected by the overheat detectable sensor 74. Therefore, the image forming operation can be continued in the normal mode as it is continued with the recording sheet P1 and P1, and the heat roller 71 can be avoided from being overheated.

Meanwhile, if the recording sheet P2 is carried in the one-sided alignment to be aligned to the left-side end of the feeding path, which is the side having the overheat detectable sensor 74 thereon, the right-side portion of the heat roller 71 may be excessively heated. Because the right-side portion of the heat roller 71 is not provided with the overheat detectable sensor 74, the excessively increased temperature is not detectable. Accordingly, if the image forming operation is continued with the excessively heated heat roller 71, the bearings to hold the heat roller 71 may melt and be deformed.

Therefore, when the recording sheet P is discharged within the predetermined time period after the input of the image data, and when the judging unit 110 judges that the recording sheet P is fed in the one-sided alignment, the controller unit 120 controls the color printer 1 to restrict the temperature of the heat roller 71 from being further increased.

In other words, when the judging unit 110 judges that the recording sheet P is fed in the one-sided alignment based on the results indicating that solely the left-side swing-detectable sensor 94R detects the swing movement of the left-side swingable piece 93L, the controller unit 120 controls the color printer 1 to enter a heat-restriction mode, in which the temperature of the heat roller 71 is prevented from being further increased regardless of the result detected by the overheat detectable sensor 74. Further, in the heat-restriction mode, the controller unit 120 may control the informer unit 80 to inform the user of alert concerning the one-sided alignment of the recording sheet P by, for example, displaying a message and generating an alarm sound.

The heat in the heat roller 71 can be prevented from being further increased by, for example, ceasing the heat generation in the heat roller 71, similarly to the case in which the overheat detectable sensor 74 detects the excessive heat. In this regard, if the color printer 1 is in the image forming operation, the operation is ceased as well. The heat generation in the heat roller 71 may be ceased immediately or after the images are formed on a predetermined number of recording sheets P. Alternatively, the image forming operation may be continued with decreased temperature in the heat roller 71.

For another example, the heat in the heat roller 71 can be prevented from being further increased by lowering an image forming speed of the color printer 1. When the image forming speed is lowered, a rotation speed of the heat roller 71 is lowered accordingly, and the temperature can be distributed in the heat roller 71 due to thermal migration. Thus, partial increase of the temperature within the heat roller 71 can be prevented.

For another example, the heat in the heat roller 71 can be prevented from being further increased by lowering a threshold temperature for the heat roller 71, which is referred to when overheat in the heat roller 71 is judged. When the minimum-allowable sized recording sheet Ps is in the one-sided alignment aligned to the left (i.e., when the recording sheet P is fed in the position of P2 in FIG. 5A), the left-side portion of the heat roller 71 releases heat to the recording sheet P2 being fed, and the temperature in the left-side portion of the heat roller 71 tends not to be increased. However, during an image forming operation with a plurality of recording sheets P2 being fed, the temperature may be still increased moderately. Therefore, based on preliminarily determined correlationship between the temperature at the left-side portion and the right-side portion of the heat roller 71 with the recording sheets Ps in the one-sided alignment aligned to the left side in the discharge path 91, the temperature of the right-side portion of the heat roller 71 may be estimated with reference to the temperature in the left-side portion of the heat roller 71. Thus, excessively increased temperature in the right-side portion of the heat roller 71 can be determined rather indirectly. When the overheat detectable sensor 74 indirectly detects the excessively increased temperature in the right-side portion of the heat roller 71, heat generation in the heat roller 71 is ceased, similarly to the controlling flow in the normal mode.

Figure 6:
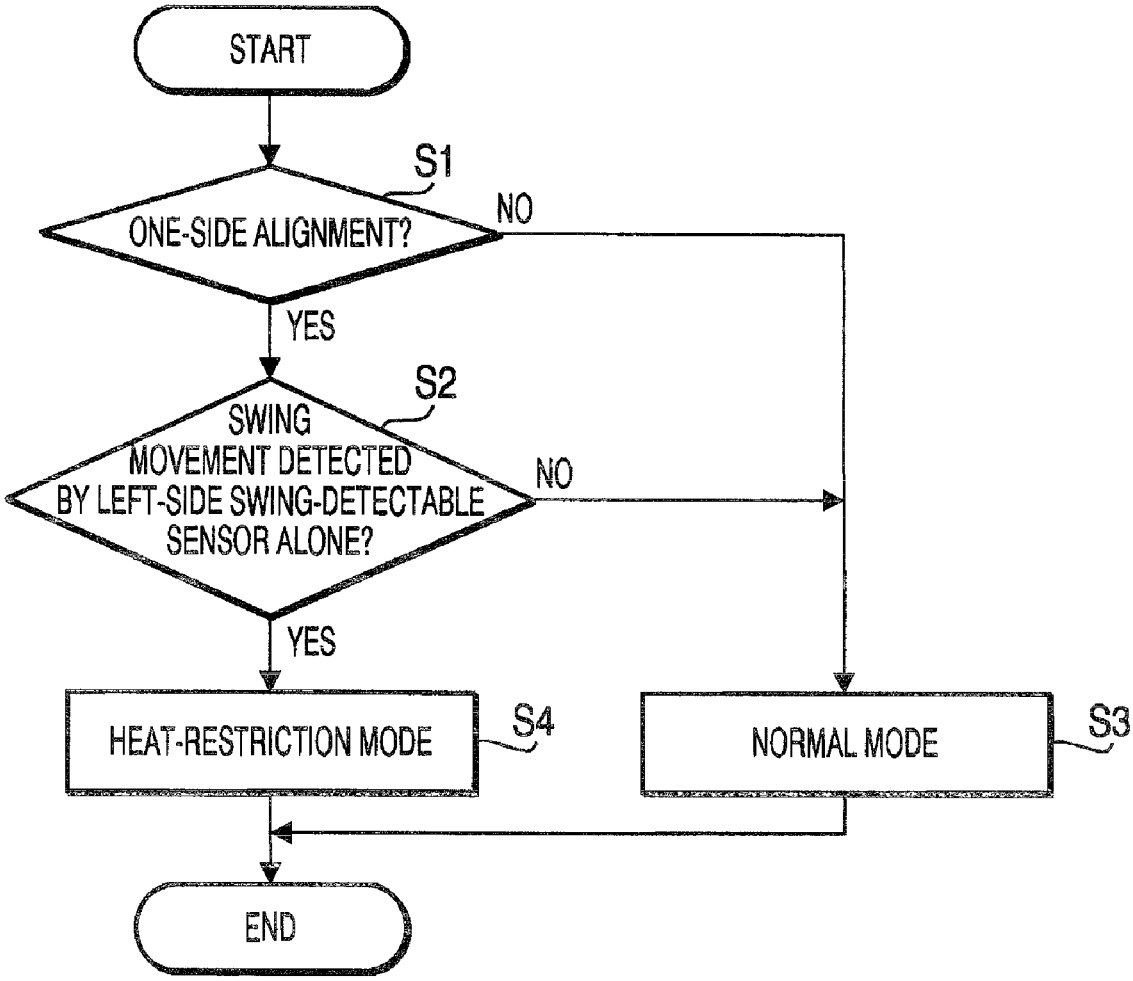
FIG. 6 is a flowchart to illustrate a controlling flow to control the color printer according to the embodiment of the present invention.

The judgment to be made by the judging unit 110 and the controlling flow after the judgment are described with reference to a flowchart shown in FIG. 6. When judging starts, in S1, the controller device 100 judges as to whether the recording sheet P is in the one-sided alignment. If the recording sheet P is in the centered alignment (S1: NO), in S3, the controller device 100 continues to control the color printer 1 in the normal mode. In the normal mode, if the overheat detectable sensor 74 detects excessively increased heat in the heat roller 71 when, for example, smaller-sized recording sheets Ps (e.g., the recording sheet P1 in FIG. 5A), which are smaller than the maximum-allowable sized recording sheet P1, are fed in the centered alignment, the controller device 100 ceases the heat generation in the heat roller 71 and controls the informer unit 80 to inform the user of alert concerning the overheat in the heat roller 71.

In S1, if the recording sheet P is in the one-sided alignment (S1: YES), in S2, the controller device 100 determines as to whether the judgment was made based on the swing movement of the left-side swing-detectable sensor 94L alone and that no swing movement was detected by the right-side swing-detectable sensor 94R.

In S2, if the judgment was made based on the swing movement of the right-side swing-detectable sensor 94R alone (S2: NO), in S3, the controller device 100 continues to control the color printer 1 in the normal mode.

In S2, meanwhile, if the judgment was made based on the swing movement of the left-side swing-detectable sensor 94L alone (S2: YES), in S4, the controller device 100 enters the heat-restriction mode, in which the heat in the heat roller 71 is prevented from being further increased regardless of the result detected by the overheat detectable sensor 74.

According to the color printer 1 in the above configuration, it is to be noted that the swing movement of the swingable pieces 93, which have been provided in conventional printers to suppress the recording sheets P being discharged downward, are utilized to determine the alignment of the recording sheets P. In the color printer 1 in the above embodiment, therefore, the one-sided alignment of the recording sheet P can be easily detected without additional sensors to detect the one-sided alignment of the recording sheet P in the feeding path or in the feeder unit 20. In other words, the one-sided alignment of the recording sheet P can be detected whilst manufacturing cost of the color printer 1 is prevented from being largely increased.

In the above embodiment, the judging unit 110 determines that the recording sheet P is in the one-sided alignment when solely one of the swing-detectable sensors 94 detects the swing movement of the swingable piece 93 and the other of the swing-detectable sensors 94 detects no swing movement. Therefore, to which side the recording sheet P is aligned can be detected. Thus, the color printer 1 is controlled to effectively behave in accordance with the side on which the recording sheet P is aligned.

In the above embodiment, the controlling flow, in which the color printer 1 is shifted to operate in the heat-restriction mode when the left-side swing-detectable sensor 94L alone detects the swing movement and the right-side swing-detectable sensor 94R does not detect the swing movement, is illustrated. However, the color printer 1 may not necessarily be shifted to operate in the heat-restriction mode immediately. Rather, for example, when the left-side swing-detectable sensor 94L alone detects the swing movement and it is determined that the recording sheet P is in the one-sided alignment, the controller device 100 may control the informer unit 80 to inform the user of alert concerning the one-sided alignment. When, for example, the user corrects the alignment of the recording sheet P to the centered-alignment, the image forming operation may resume. Alternatively, if the user does not correct the alignment of the recording sheet P but the one-sided alignment is maintained for a predetermined time period, the heat in the heat roller 71 can be prevented from being further increased after the predetermined time period.

In the above embodiment, the controlling flow, in which the controller device 100 shifts the color printer 1 to operate in the heat-restriction mode when the recording sheet P is in the position illustrated as P2 in FIG. 5A and maintains the color printer 1 to operate in the normal mode when the recording sheet is in the position illustrated as P3. However, the controller device 100 may, for example, shift the color printer 1 to operate in the heat-restriction mode regardless of the side on which the recording sheet P is as long as the recording sheet P is in the one-sided alignment.

In the above embodiment, the color printer 1 is provided with two swingable pieces 93, although the quantity of the swingable pieces 93 is not limited to two. However, the present invention may be applied to a printer having three or more swingable pieces 93. In that regard, the swing-detectable sensors 94 are provided to one of the swingable pieces at positions corresponding to both widthwise ends of the minimum-allowable sized recording sheet Ps.

Second Embodiment

Next, a second embodiment of the present invention will be described with reference to FIGS. 7A, 7B. In the description below, components and behaviors of the color printer identical to those in the first embodiment will be referred to by identical reference signs, and explanation of those will be omitted.

Figures 7A, 7B:
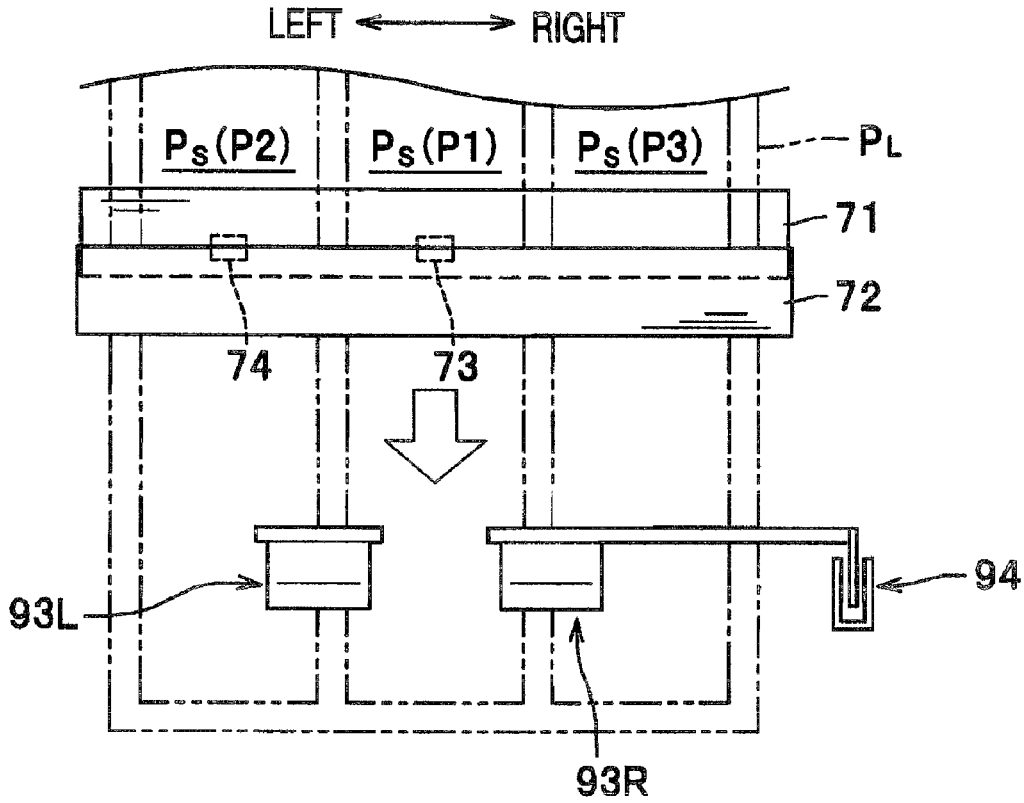
FIG. 7A illustrates a sheet-feeding behavior in the color printer according to a second embodiment of the present invention.
FIG. 7B is a table to illustrate criteria to judge one-sided alignment of the sheet and judgment results to be derived in the color printer according to the second embodiment of the present invention.

As shown in FIG. 7A, the fixing unit 70 according to the second embodiment is provided with solely one swing-detectable sensor 94, which detects swing movement of the right-side swingable piece 93R.

In particular, the right-side swingable piece 93R is arranged in a position, in which the minimum-allowable sized recording sheet Ps can reach the right-side swingable piece 93R at the right-side end thereof when the recording sheet Ps is carried normally in the centered alignment in the discharge path 91 and at the left-side end thereof when the recording sheet Ps is carried in the right-sided alignment. When the minimum-allowable sized recording sheet Ps is carried in the left-sided alignment, the recording sheet Ps does not contact the right-side swingable piece 93R at any portion.

The overheat detectable sensor 74 is arranged in a position to detect the temperature in the vicinity of and above one of the axial ends of the heat roller 71 closer to the left-side end in the widthwise direction. Thus, the overheat detectable sensor 74 detects temperature of the circumferential surface of the left-side portion of the heat roller 71. The fixing unit 70 does not have an overheat detectable sensor to detect temperature of the circumferential surface of the right-side portion of the heat roller 71.

Next, a method to judge one-sided alignment of the recording sheet P by the judging unit 110 will be described. Judging starts when the image data to be printed is inputted in the color printer.

When the image data is inputted, the recording sheet P is fed by the feeder unit 20 to have the image formed thereon in the image forming unit 30. The recording sheet P is thereafter discharged out of the chassis 10 by the discharge unit 90, and if the right-side retainer 93 swings, the swing-detectable sensor 94 detects the swing movement of the right-side retainer 93.

According to the result detected by the swing-detectable sensor 94, the judging unit 110 determines that the recording sheet P is fed in the one-sided alignment when no swing movement is detected by the swing-detectable sensor 94 within the predetermined time period which starts upon input of the image data and ends, for example, upon completion of discharge of the recording sheet P.

In particular, as shown in FIGS. 7A and 7B, if the minimum-allowable sized recording sheet Ps (i.e., P1 and P3) or a recording sheet P1 in the maximum allowable size can reach the right-side swingable piece 93R when the recording sheet Ps is carried in the centered alignment normally or in the right-sided alignment and when the recording sheet P1 is carried, the recording sheet Ps, P1 rotatably uplifts the right-side swingable piece 93R to swing. Therefore, the swing-detectable sensor 94 detects the swing movement of the right-side swingable piece 93R within the predetermined time period, and affirmative (+) judgment is made for the result detected by the swing-detectable sensor 94. Thus, the judging unit 110 determines that the recording sheet P is fed in the centered alignment (i.e., judgment "CENTER" is made).

When the minimum-allowable sized recording sheet Ps is in the position P3, and if judgment is made that the recording sheet Ps is in the centered alignment, excessively increased heat in the heat roller 71 can be detected by the overheat detectable sensor 74. Therefore, even with the judgment of the centered alignment, the heat in the heat roller 71 can be controlled without a problem.

Meanwhile, when the minimum-allowable sized recording sheet Ps is carried in the position P2 closer to the left side, on which the overheat detectable sensor 74 is provided, the recording sheet Ps does not contact the right-side swingable piece 93R at any portion. Therefore, the right-side swingable piece 93R does not swing, and negative (−) judgment is made for the result obtained from the swing-detectable sensor 94. Thus, the judging unit 110 determines that the recording sheet P is fed in the one-sided alignment (i.e., judgment "ONE-SIDE" is made). Accordingly, the controller unit 120 controls the color printer 1 to enter a heat-restriction mode.

According to the second embodiment, the one-sided alignment of the recording sheet P, specifically aligned to the side on which the overheat detectable sensor 74 is provided, can be detected even with solely one swing-detectable sensor 94. That is, the one-sided alignment of the recording sheet P can be detected with a smaller quantity (e.g., one) of the swing-detectable sensor 94, and manufacturing cost for the color printer 1 can be reduced.

In the configuration illustrated in FIG. 7A, the color printer 1 is provided with two swingable pieces 93. However, the quantity of the swingable pieces 93 in the color printer 1 is not limited to two. The present invention may be applied to a printer having, for example, one, three, or more swingable pieces 93. When the printer to be applied to the present invention is equipped with three or more swingable pieces 93, the swing-detectable sensor 94 may be provided to one of the swingable pieces 93 at a position corresponding to one widthwise end of the minimum-allowable sized recording sheet Ps.

Although examples of carrying out the invention have been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, in the above embodiments, judging as to whether the recording sheet P is in the one-sided alignment starts upon input of the image data. In other words, the judgment is made during an image forming operation of the color printer 1. However, the judgment may be made in a specific operation mode, in which the color printer 1 is shifted specifically to judge the alignment of the recording sheet P.

In the above embodiments, the judging unit 110 judges the alignment of the recording sheet P based on the detected results obtained from the swing-detectable sensor(s) 94 within the predetermined time period, which starts upon input of the image data. However, the judging may not necessarily be started upon input of the image data as long as the judgment is made when the recording sheet P is discharged by the discharge unit 90. In other words, for example, the judgment may be made within a time period starting upon detection of the recording sheet P in a specific point in the feeding path or upon activation of the feeder unit 20 starting to feed the recording sheet P.

In the above embodiments, the existing parts to restrain the recording sheet P in the discharge path 91 in the color printer 1 are used to serve as the swingable pieces 93. However, any other existing parts in the color printer, which can swing by the pressure from the recording sheet P being discharged, may be used in place of the swingable pieces 93. For example, a swingable actuator of a sensor capable of detecting an amount of the recording sheet discharged to be stacked on a discharge tray may be used. When the color printer is provided with a sensor to detect the swing movement of the actuator, the sensor may be used to serve as the swing-detectable sensor. In this regard, it is not necessary to provide an additional swing-detectable sensor to the printer, and the one-sided alignment of the recording sheet P can be detected by adjusting the controller device. Accordingly, the printer capable of controlling the heat in the heat roller can be provided without large increase of the manufacturing cost.

In the above embodiments, the fixing unit 70 includes the heat roller 71 and the pressure roller 72. However, the heat roller 71 may be replaced with, for example, a heater formed in a film, and the pressure roller 72 may be replaced with a belt-formed presser.

In the above embodiments, the fixing unit 70 is provided with two separate temperature sensors, which are the temperature-control sensor 73 and the overheat detectable sensor 74. However, the fixing unit 70 may be provided with, for example, solely one temperature sensor which can detect the temperature in the heat roller 71 serve as the temperature-control sensor 73 and the overheat detectable sensor 74 concurrently.

In the above embodiments, the present invention is applied to the color printer 1, in which the recording sheet P is normally carried in the centered alignment so that the recording sheet P is carried to have its widthwise center be aligned to a widthwise center of the feeding path. However, the present invention can be similarly applied to a printer, in which a recording sheet is normally carried in the one-sided alignment and one side of the recording sheet is aligned to a widthwise end of the feeding path. Even in such a printer, the recording sheet may be carried in one-sided alignment, in which the recording sheet is aligned to the other widthwise end of the feeding path, and which is to be detected.

In the above embodiments, the present invention is applied to the color printer 1, in which the photosensitive drum is exposed to the illumination of the LEDs. However, the present invention may be applied to a printer in which the photosensitive drum is exposed to laser beams. Further, the present invention may be applied to, for example, a copier and an MFP (multifunction peripheral).

The recording sheet P illustrated in the above embodiments may be standard-sized paper, which includes a letter-sized sheet, a regular-sized postcard or envelope. Alternatively, the recording sheet P may be free-sized paper, which is arbitrarily cut by the user. Further the recording sheet P may not necessarily be paper, but may be, for example, an OHP film sheet.

What is claimed is:

1. An image forming apparatus, comprising:

a fixing unit to thermally fix an image transferred onto a sheet;

a discharge unit to discharge the sheet carried from the fixing unit outside the image forming apparatus through a discharge path;

at least one swingable member to be swung by the sheet being discharged;

a swing-detectable sensor to detect swing movement of the at least one swingable member being swung by the sheet; and a judging unit to judge as to whether the sheet is in one-sided alignment, in which the sheet is aligned to only one of the widthwise sides in the discharge path based on result detected by the swing-detectable sensor.

2. The image forming apparatus according to claim 1, wherein the at least one swingable member includes a first swingable member, which is reachable to be swung by one of two widthwise ends of a minimum-allowable sized sheet, and a second swingable member, which is swingable independently from the first swingable member and reachable by the other of the two widthwise ends of the minimum-allowable sized sheet, the minimum-allowable sized sheet having a smallest allowable width to be processed in the image forming apparatus;

wherein the swing-detectable sensor is provided correspondingly to each of the first swingable member and the second swingable member; and wherein the judging unit judges that the sheet being discharged is in the one-sided alignment when one of the swing-detectable sensors detects swing movement of the corresponding swingable member and the other of the swing-detectable sensors detects the corresponding swingable member being still.

3. The image forming apparatus according to claim 2, wherein the fixing unit is provided with a heater including two regions and a temperature sensor to detect temperature in one of the two regions in the heater closer to the first swingable member; and wherein temperature in the heater is restricted from being increased when the judging unit judges that the sheet being discharged is in the one-sided alignment based on the swing movement of the first swingable member and stillness of the second swingable member detected by the swing-detectable sensors.

4. The image forming apparatus according to claim 3, wherein the temperature in the heater is restricted from being increased when the judging unit judges that the sheet being discharged is in the one-sided alignment based on stillness of the first swingable member and the swing movement of the second swingable member detected by the swing-detectable sensors and when the temperature sensor detects the temperature in the one of the two regions in the heater closer to the first swingable member being higher than a predetermined temperature.

5. The image forming apparatus according to claim 2, wherein the fixing unit is provided with a heater including two regions and a temperature sensor to detect temperature in one of the two regions in the heater closer to the first swingable member; and wherein the image forming apparatus comprises an informer unit to alert a user of the image forming apparatus when the judging unit judges that the sheet being discharged is in the one-sided alignment based on the swing movement of the first swingable member and stillness of the second swingable member detected by the swing-detectable sensors.

6. The image forming apparatus according to claim 5, wherein the informer unit alerts the user when the judging unit judges that the sheet being discharged is in the one-sided alignment based on stillness of the first swingable member and the swing movement of the second swingable member detected by the swing-detectable sensors and when the temperature sensor detects the temperature in the one of the two regions in the heater closer to the first swingable member being higher than a predetermined temperature.

7. The image forming apparatus according to claim 1, wherein the at least one swingable member includes at least a first swingable member, which is reachable to be swung by one of two widthwise ends of a minimum-allowable sized sheet, the minimum-allowable sized sheet having a smallest allowable width to be processed in the image forming apparatus;

wherein the swing-detectable sensor is provided correspondingly to the first swingable member;

wherein the fixing unit is provided with a heater including two regions and a temperature sensor to detect temperature in one of the two regions in the heater closer to the other of the two widthwise ends of the minimum-allowable sized sheet; and wherein the judging unit judges that the sheet being discharged is in the one-sided alignment when the swing-detectable sensor detects the first swingable member being still.

8. The image forming apparatus according to claim 1, wherein the discharge unit includes an outlet, through which the sheet is discharged out of the discharge unit; and wherein the at least one swingable member is arranged in vicinity of the outlet of the discharge unit.

* * * * *